US005160031A

United States Patent [19]

Palisin, Jr. et al.

[11] Patent Number: 5,160,031

[45] Date of Patent: * Nov. 3, 1992

[54] NESTABLE CONTAINER AND METHOD OF MAKING

[75] Inventors: Stephen P. Palisin, Jr., South Euclid; Raymond J. Keller, Macedonia, both of Ohio

[73] Assignee: Berwick Manufacturing Inc., Cleveland, Ohio

[ * ] Notice: The portion of the term of this patent subsequent to Aug. 20, 2008 has been disclaimed.

[21] Appl. No.: 746,480

[22] Filed: Aug. 16, 1991

Related U.S. Application Data

[63] Continuation of Ser. No. 495,856, Mar. 19, 1990, and a continuation of Ser. No. 495,853, Mar. 19, 1990, Pat. No. 5,040,682, which is a continuation-in-part of Ser. No. 271,157, Nov. 14, 1988, Pat. No. 4,909,393, and Ser. No. 270,123, Nov. 14, 1988, and Ser. No. 270,122, Nov. 14, 1988, and Ser. No. 299,957, Jan. 23, 1989, and Ser. No. 372,300, Jun. 23, 1989.

[51] Int. Cl.[5] ..... B65D 1/16

[52] U.S. Cl. ..... 206/519; 72/349; 220/669; 413/69

[58] Field of Search ..... D9/325; D34/39; 29/401.1; 72/343, 347, 349–352, 354, 358, 361, 369, 370, 379; 206/519, 520; 220/561, 669–674; 413/1, 4, 9, 69, 78

[56] References Cited

U.S. PATENT DOCUMENTS

| | | | |
|---|---|---|---|
| D. 97,580 | 11/1935 | Ingersoll | D34/39 |
| D. 122,336 | 9/1940 | James | D9/325 |
| D. 183,541 | 9/1958 | Plochmann, Jr. | D9/325 |
| D. 220,612 | 5/1971 | Siegler | D9/325 |
| D. 228,489 | 10/1973 | Mascia | D9/325 |
| D. 237,251 | 10/1975 | Plummer | D9/325 |
| 685,832 | 11/1901 | Gender | 220/72 |
| 784,950 | 3/1905 | Lindsay | 220/1 R |
| 1,345,594 | 7/1920 | Grob | 72/347 |
| 1,446,158 | 2/1923 | Clymer | 29/401.1 |

(List continued on next page.)

FOREIGN PATENT DOCUMENTS

| | | | |
|---|---|---|---|
| 0136632 | 3/1948 | Australia | 220/72 |
| 0742538 | 9/1966 | Canada . | |
| 1265282 | 5/1961 | France | 72/358 |
| 2431962 | 6/1979 | France . | |
| 0605161 | 5/1960 | Italy . | |
| 0754549 | 8/1956 | United Kingdom | 220/72 |

*Primary Examiner*—Jimmy G. Foster

*Attorney, Agent, or Firm*—Watts, Hoffmann, Fisher & Heinke Co.

[57] ABSTRACT

An open-top container that is generally circular in cross-section and is formed from deformable metal by utilizing a press to force bottom portions of an upwardly opening workpiece into a die to carry out drawing operations that alter bottom and side wall portions of the workpiece to elongate the workpiece and to provide the workpiece with tapered, fluted side portions that enable the resulting container to be nested with a like container for empty shipment and storage in a minimum of space. As a part of the container configuration process, each container is provided with a pluraltiy of vertically extending "flutes" that extend along the side walls of the container, and with at least one ring-like formation that serves to enhance container strength, container stability and/or container handling characteristics. In preferred practice, each container is provided with a pair of vertically spaced, circumferentially extending ring-like formations that are located atop upper end regions of the vertically extending flutes, with these ring formations being provided by expanding upper side wall portions of the container. In preferred practice, each container also is provided with one press-formed, downwardly extending ring-like formation that provides a juncture between the container's fluted side wall and a raised bottom wall portion that is of substantially circular configuration. The depending ring formation preferably provides a planar bottom surface for supporting the container atop a flat surface with good stability.

35 Claims, 12 Drawing Sheets

U.S. PATENT DOCUMENTS

| | | | |
|---|---|---|---|
| 1,527,897 | 2/1925 | Mittinger | 220/72 |
| 1,746,869 | 2/1930 | Rosenthal | 29/401.1 |
| 2,406,380 | 8/1946 | Johnston, Jr. | 220/72 |
| 2,412,178 | 12/1946 | Seigh . | |
| 2,423,708 | 7/1947 | Keogh et al. | 413/1 |
| 2,832,496 | 4/1958 | Williams | 220/5 R |
| 2,943,386 | 7/1960 | Katz | 413/4 |
| 3,344,646 | 10/1967 | Moller | 72/348 |
| 3,419,176 | 12/1968 | Lipfert et al. | 220/23.4 |
| 3,425,382 | 2/1969 | Johnson | 413/1 |
| 3,461,699 | 8/1969 | Roth | 72/56 |
| 3,529,743 | 9/1970 | Ehrbar et al. . | |
| 3,659,741 | 5/1972 | Corelli | 220/72 |
| 3,786,667 | 1/1974 | Garnett, Jr. | 72/348 |
| 3,811,393 | 5/1974 | Close | 72/348 |
| 3,910,414 | 10/1975 | McCay | 220/268 |
| 3,940,008 | 2/1976 | Flanders | 220/319 |
| 3,942,670 | 3/1976 | Mingus et al. | 220/23.4 |
| 3,949,877 | 4/1976 | Santoni | 206/519 |
| 4,040,372 | 8/1977 | Flanders | 413/9 |
| 4,366,696 | 1/1983 | Durgin et al. | 72/339 |
| 4,416,374 | 11/1983 | Smith et al. | 220/1.5 |
| 4,512,700 | 4/1985 | Santoni | 413/4 |
| 4,597,502 | 7/1986 | Troughton | 220/77 |
| 4,648,522 | 3/1987 | Wise | 220/5 R |
| 4,723,681 | 2/1988 | Glerum | 220/72 |
| 4,909,393 | 3/1990 | Palisin, Jr. | 206/519 |

NESTABLE CONTAINER AND METHOD OF MAKING

CROSS-REFERENCE TO RELATED APPLICATIONS

The present application is a co-pending continuation of utility application Ser. No. 495,853, filed Mar. 19, 1990, which is a continuation-in-part of utility application Ser. No. 271,157 filed Nov. 14, 1988, respectively issued Aug. 20, 1991 as U.S. Pat. No. 5,040,682 (herein the "Parent Application"), and Mar. 20, 1990 as U.S. Pat. No. 4,909,393 (herein the "Parent Utility Case"), both entitled CONTAINER RECONFIGURING SYSTEM, the disclosures of which are incorporated herein by reference. The present application is also a continuation of design application filed Mar. 19, 1990, Ser. No. 495,856, entitled NESTABLE CONTAINER WITH FLUTED AND RINGED SIDE WALL JOINED BY DEPENDING RING FORMATION EXTENDING CIRCUMFERENTIALLY ABOUT CIRCULAR BOTTOM WALL (referred to hereinafter as the "Companion Case"), the disclosure of which is incorporated herein by reference.

The Parent Application also was a continuation-in-part of each of the following design applications (referred to collectively herein, together with the previously referenced design case, as the "Parent Design Cases"), the disclosures of which are incorporated herein by reference:

1) U.S. Ser. No. 270,123 filed Nov. 14, 1988 entitled NESTABLE CONTAINER WITH SEAMED, FLUTED SIDE WALL;
2) U.S. Ser. No. 270,122 filed Nov. 14, 1988 entitled NESTABLE CONTAINER LINER;
3) U.S. Ser. No. 299,957 filed Jan. 23, 1989 entitled NESTABLE CONTAINER WITH SEAMED, DIMPLED & FLUTED SIDE WALL; and
4) U.S. Ser. No. 372,300 filed Jun. 23, 1989 entitled NESTABLE CONTAINER WITH SEAMED, RINGED AND FLUTED SIDE WALL.

BACKGROUND OF THE INVENTION

1. Field of the Invention

The present invention relates to an open-top container that is formed from deformable metal, by elongating a metallic workpiece and providing the container with tapered, fluted side portions that enable multiple containers to be nested for empty shipment and storage of a maximum number of containers in a minimum amount of space. Each container has at least one ring-like formation extending about a peripheral portion of the container to strengthen the container, to improve the container's stability, and/or to improve its handling characteristics. Other aspects of the invention relate to features of the nestable containers that are produced through use of the system of the invention, and to the utilization of these nestable containers to maximize the container carrying capacity of valuable cartage and storage space.

2. Prior Art

Open-top containers are well known that are of generally cylindrical shape and have circular bottom walls that are connected along circumferentially extending seams to upstanding, generally cylindrical side walls. Examples include containers that range in character from small "tin cans" of the type that are used to contain household food-stuffs, to relatively large steel drums that are utilized in industry. While the present invention is discussed principally in conjunction with its applicability to relatively large, open-top, steel drums of the type that are reused repeatedly in industry, it will be understood by those skilled in the art that features of the invention are not limited in their application to use with industrial drums that are formed from steel. Likewise, while the present invention is discussed principally in conjunction with its applicability to the configuring of containers such as industrial drums, many of which already have seen service in industry, it will be understood by those skilled in the art that features of the invention are not limited in their application to use with "used" containers such as industrial drums, but rather can be employed quite advantageously in conjuction with the formation of nestable new containers.

Because the cost of cleaning or otherwise reconditioning open-top containers such as steel drums to enable the drums to be reused is a mere fraction of the cost of manufacturing replacement drums, it has become a widely accepted practice in industry to repeatedly reuse steel drums. Used and reconditioned drums are not only available for purchase but have come to comprise commodities having such value that large storage spaces in warehouses often are devoted to the storage of empty, reusable drums. Likewise, in view of the relatively low cost that is associated with reusing existing steel drums—as compared to the much higher cost that is associated with purchasing new drums for one-time use—it has become quite commonplace for relatively large volumes of expensive cartage space to be utilized for the transport of empty drums to sites where the drums are to be reused.

A problem with the empty storage and empty shipment of open-top containers of standard size such as steel drums is that the generally cylindrical shape of these containers prohibits the containers from being even partially nested one within another to permit the empty containers to be stacked or otherwise grouped to make efficient use of the space that they occupy. Each container of standard size that is added to a storage space in a warehouse, or to a transport space in a semi-trailer truck or a railroad boxcar, does nothing to make any use of the space within such other containers in the storage or transport space.

THE REFERENCED PARENT AND COMPANION CASES

The referenced Parent Utility Case addresses the foregoing and other problems by providing a system for reconfiguring generally cylindrical containers that is particularly well suited for use with reusable industrial drums formed from metal. As will be apparent from the description and claims that follow, the present invention relates to improvement features that preferably are utilized together with features of the invention of the Parent Utility Case.

The referenced Parent Design Cases relate to container shapes and appearance features that have evolved as a part of a continuing development program that has given rise to the invention of the present case. Selected features of the present invention may be utilized with design features disclosed in the referenced Parent Design Cases.

SUMMARY OF THE INVENTION

The present invention provides an improved generally cylindrical, drum-like container having tapered, fluted side walls that is nestable with other such containers when empty. Such containers of the present invention exhibit enhanced rigidity, a high degree of stability, and improved handling characteristics.

One aspect of the present invention relates to the provision of a system for reconfiguring generally cylindrical, open-top containers that are formed from deformable metal, to provide reconfigured containers which can be nested so that space within the interior of one container of standard size can be occupied, at least in part, by portions of a like container. Features that are added to the containers during the reconfiguration process include tapered, fluted side portions that extend along a majority of the length of the sides of the reconfigured containers, and bottom wall portions that are repositioned to give the reconfigured containers enhanced height (i.e., the containers are elongated during reconfiguration). In accordance with an improvement feature of the present invention, the process of reconfiguring containers with at least one ring-like formation that enhances container characteristics.

In accordance with a further aspect of the preferred practice of the present invention, the value of new and used open-top, generally cylindrical containers formed from deformable metal is enhanced by configuring the containers through a process that causes elongation of the containers, and that causes flute and ring formations to be added to side and bottom wall portions of the containers. In preferred practice, these features are added to the original containers 1) without causing a change to any significant degree in the fluid-carrying capacity, 2) without disturbing the fluid-tight character of seams that were formed when the containers were originally fabricated, and 3) without distorting upwardly opening rim portions of the containers.

A further aspect of the preferred practice resides in the shape that is defined by containers that are formed as the result of the configuration process that is characterized by peripheral bottom wall portions drawn to define 1) a relatively smaller diameter bottom, and 2) a depending ring-like transition between a raised bottom wall portion and surrounding fluted portions.

Still another aspect of the preferred practice of the present invention resides in the capability that is provided to carry out the aforedescribed container configuration process without causing the rims that surround the open end regions of the containers to be distorted to be out-of-round, and without altering the dimensions of the rims. Indeed, in preferred practice, the deep-draw pressing operation that is utilized to carry out the majority of the configuration process is carried out in a way that causes rim portions of a container that is undergoing configuration to be restrained to counteract forces that otherwise might cause changes in rim shape and size. Therefore, conventional closure (such as lids of a standard size that are designed to be removably attached to the rim of a container to close the open end region of the container) can be used with the container.

Another feature resides in providing one or more circumferentially extending expansion-formed rings that are provided in upper side wall portions of each container at one or more locations above the vertically extending flute formations. The rings open inwardly into the interior of the container and each defines a ring-like trough. In the preferred embodiment, a pair of vertically spaced, circumferentially extending ring-like formations are provided by radially expanding spaced, circumferentially extending side wall portions. These rings not only enhance container rigidity but also serve to provide formations that can be grasped to enable containers to be moved about from place to place.

A feature of the preferred embodiment of the present invention is that the lowermost of the two circumferentially extending rings is formed after the tapered flute formations have been press-formed. This lowermost ring intercepts the tip upper end regions of the flute formations so that the resulting container tapers progressively inwardly starting immediately beneath the lowermost of the two expansion-formed ring-like formations. By this arrangement, containers are permitted to "nest" one within another, with the extent to which one container can be inserted into another limited by engagement of the lowermost ring of one container with the rim formation of a supporting container. This ring-to-rim engagement prevents nested containers from wedging together, and thereby assures ease of separation of containers from nested relationship.

Another aspect of the preferred embodiment of the present invention resides in providing one press-formed, downwardly extending ring-like formation that provides a juncture between the container's fluted side wall and a raised bottom wall portion that is of substantially circular configuration. The depending ring formation defines a ring-like bottom surface that extends to a horizontal plane for supporting the container atop a flat surface with good stability. By this arrangement, if containers need to be moved along a roller conveyor or other conveyance that provides support elements that define closely spaced components of a flat support surface, the containers can be moved about on such a surface without causing them to be shaken from side to side during such movement.

Another aspect of the preferred embodiment of the present invention resides in forming the circular, raised bottom wall portion such that it includes a slightly raised, centrally located "crown" formation. This bottom wall formation avoids an unwanted configuration (e.g. a "wavy" or significantly non-planar shape) as the result of the deep-drawing action that takes place in press-forming the flutes and the depending ring.

A feature of the preferred practice of the system of the present invention resides in an unexpected result, namely a determination that the type of container configuration that is carried out can in fact be utilized with seamed containers of the type that have circular bottom walls that are joined along a circumferentially extending seam to the lower end region of an upwardly extending, generally cylindrical side wall. Because steel drums typically have a rolled bottom wall seam where the bottom wall is joined with a surrounding side wall, and because seamed structures of this type are ordinarily thought of as being incapable of being put through a significant amount of deformation, those skilled in the art have not viewed existing steel drums as being reconfigurable.

Thus, another feature of the invention resides in the fact that the configuration system not only can be used with containers having seamed-wall construction, but that, in fact, the configuration system is found to be quite reliably usable with containers such as standard industrial drums. During the configuration process, the bottom rim seam is deformed such that it forms part of a fluted side wall of the reconfigured container. The seam is not "unlocked" or otherwise "violated" during the configuration process, and the fluid-tight integrity of the seam is preserved.

BRIEF DESCRIPTION OF THE DRAWINGS

These and other features, and a fuller understanding of the invention may be had by referring to the following description and claims taken in conjunction with the accompanying drawings, wherein:

Figure 1:
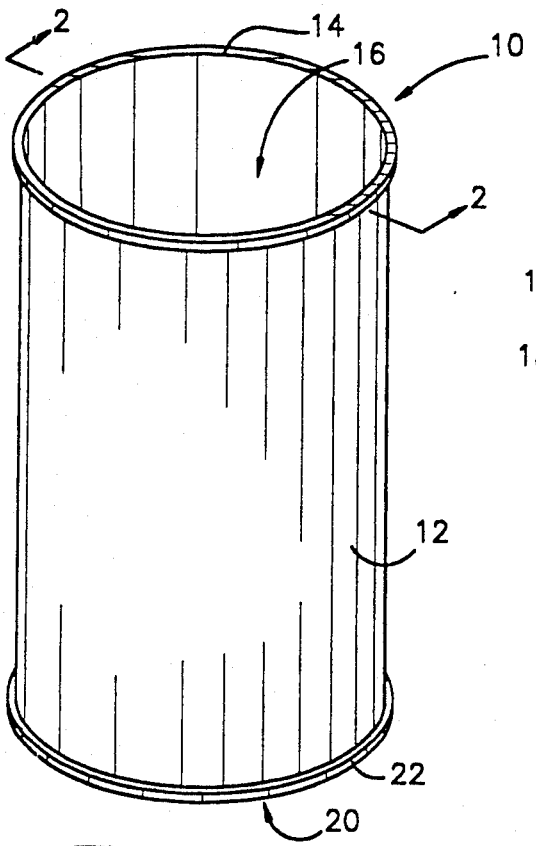
Fig.1 (PRIOR ART)
FIG. 1 is a perspective view of an open-top, generally cylindrical container of a type that is well known in the art.
Figure 3:
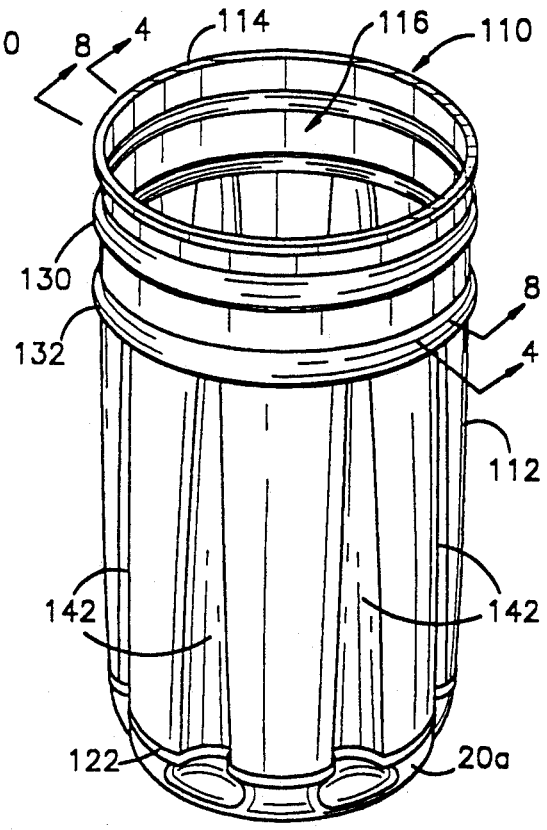
FIG. 3 is a perspective view of the container of FIG. 1 in a reconfigured form that embodies features of the present invention.
Figure 11:
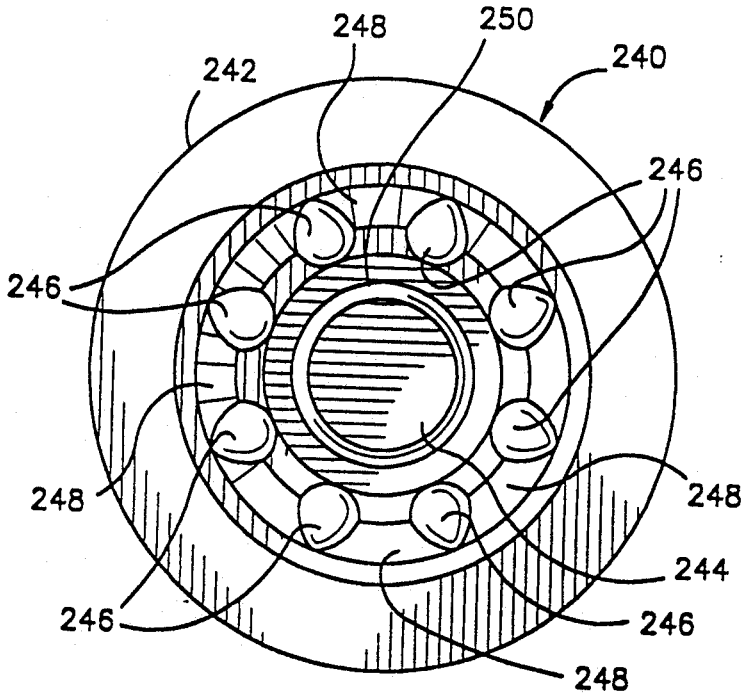
Figure 10:
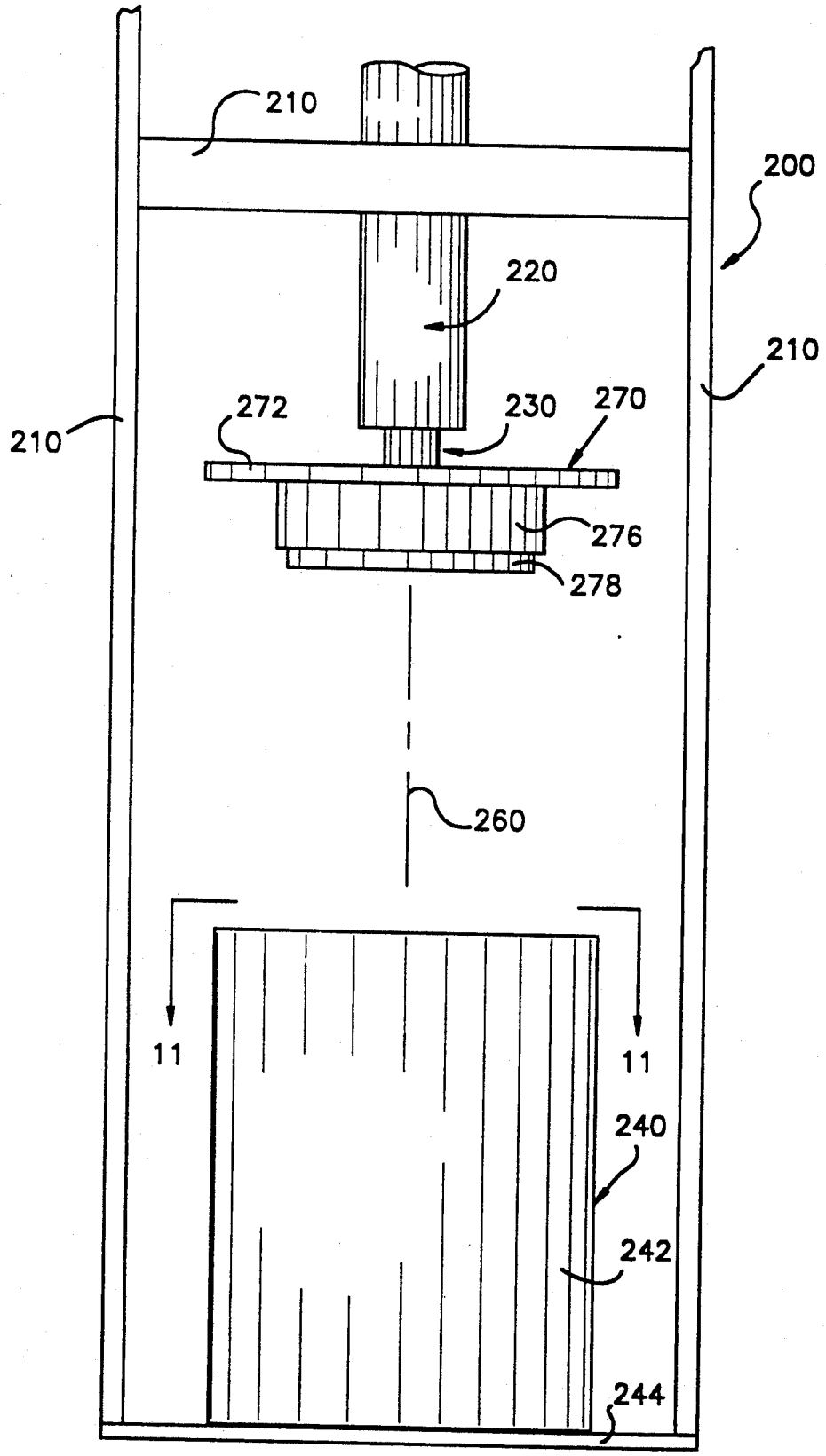
Figure 12:
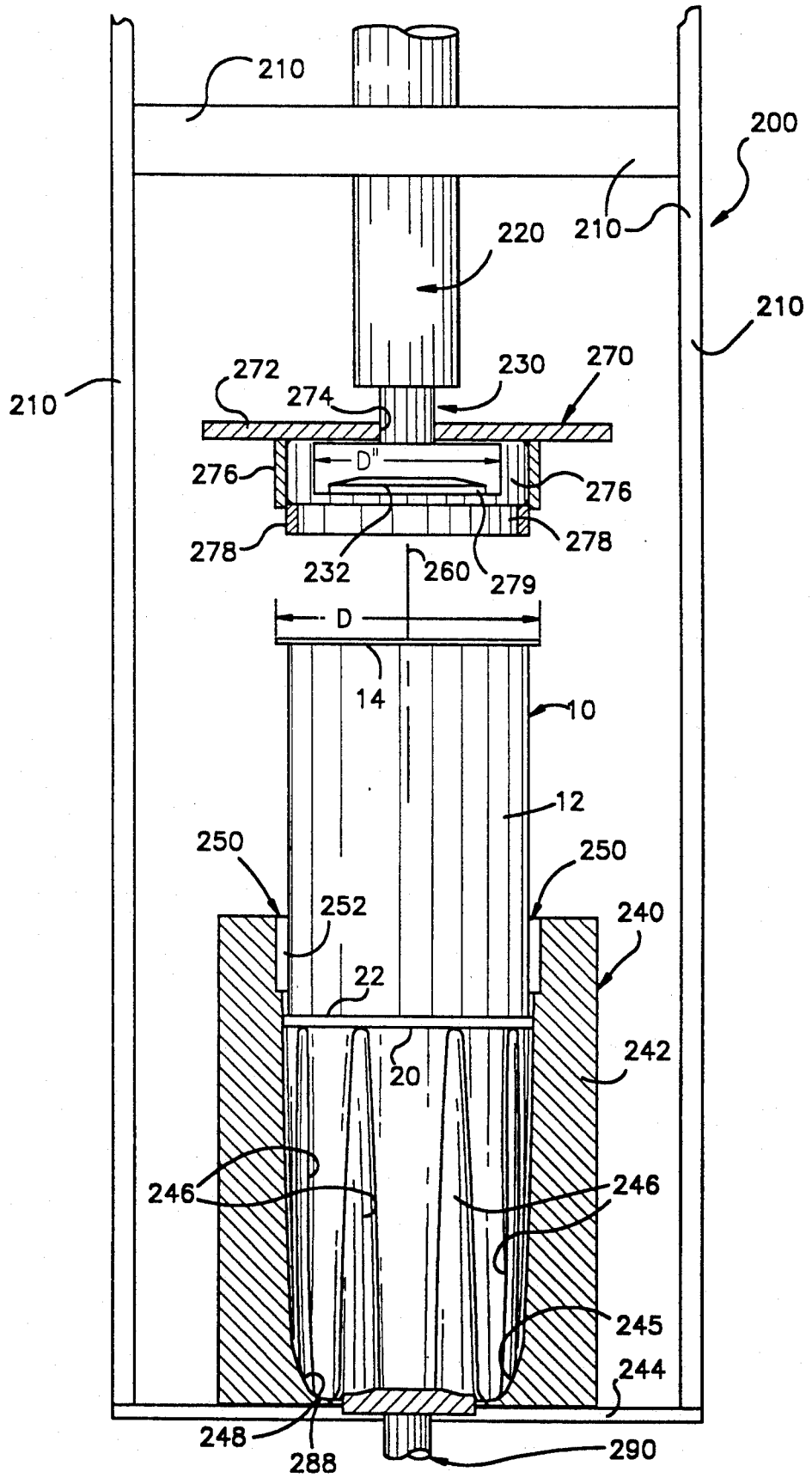
Figure 18:
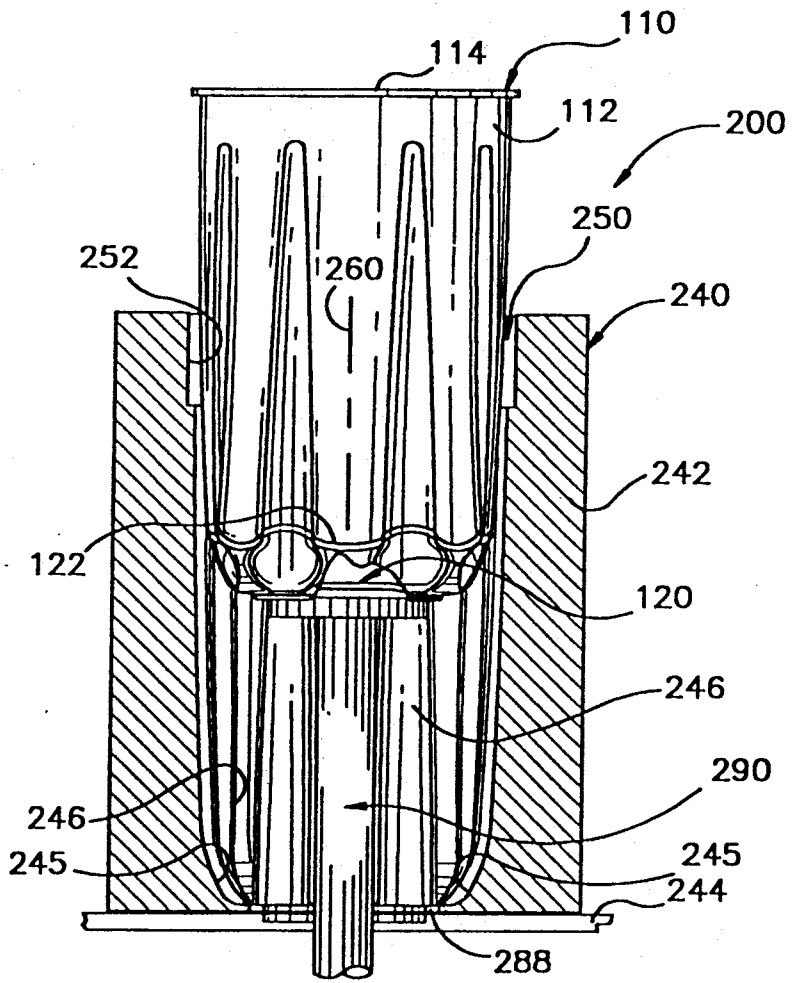
Figure 19:
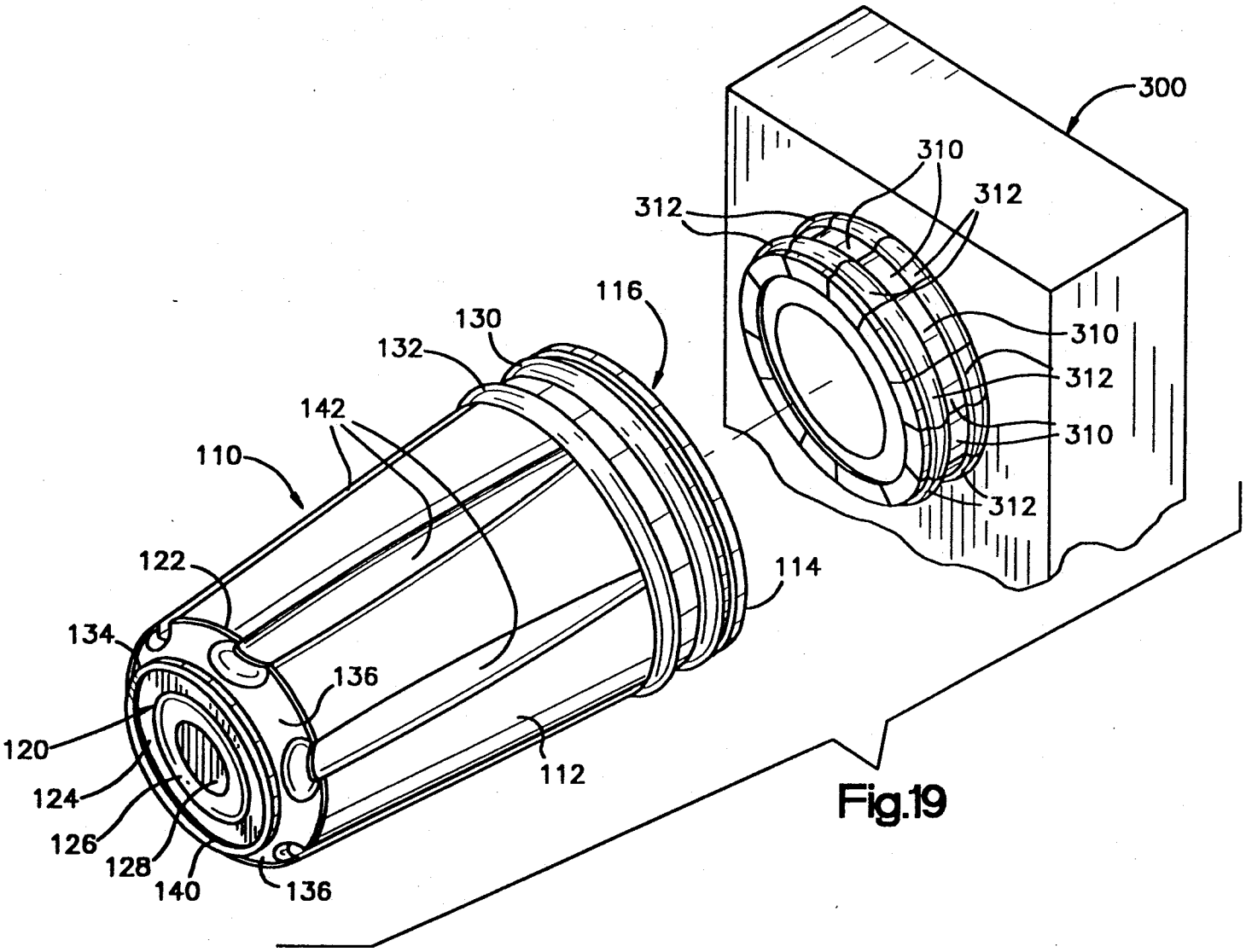
Figure 21:
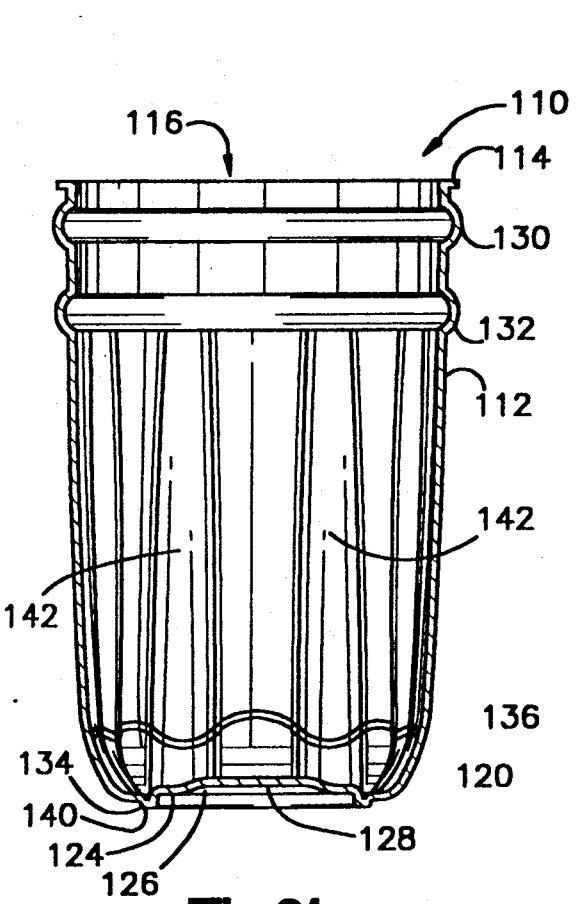
Figure 20:
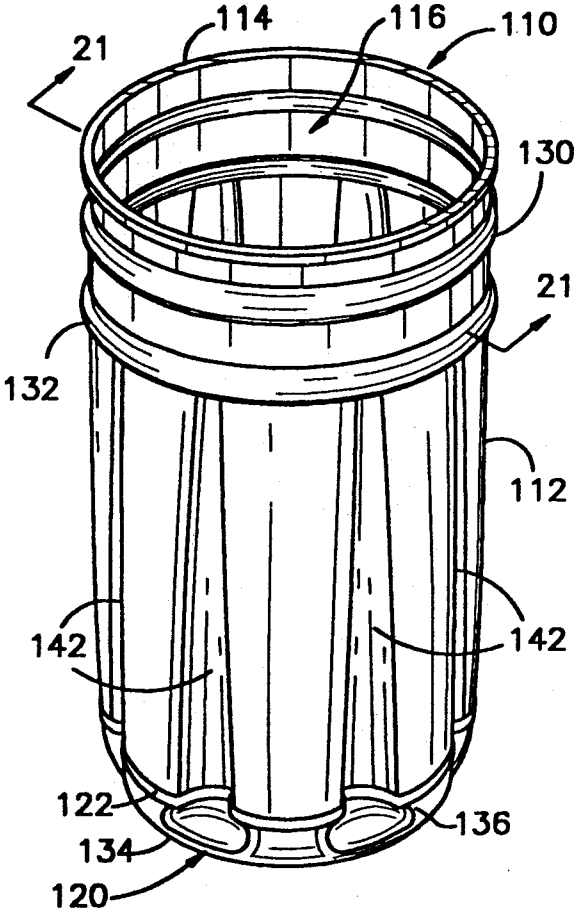
Figure 22:
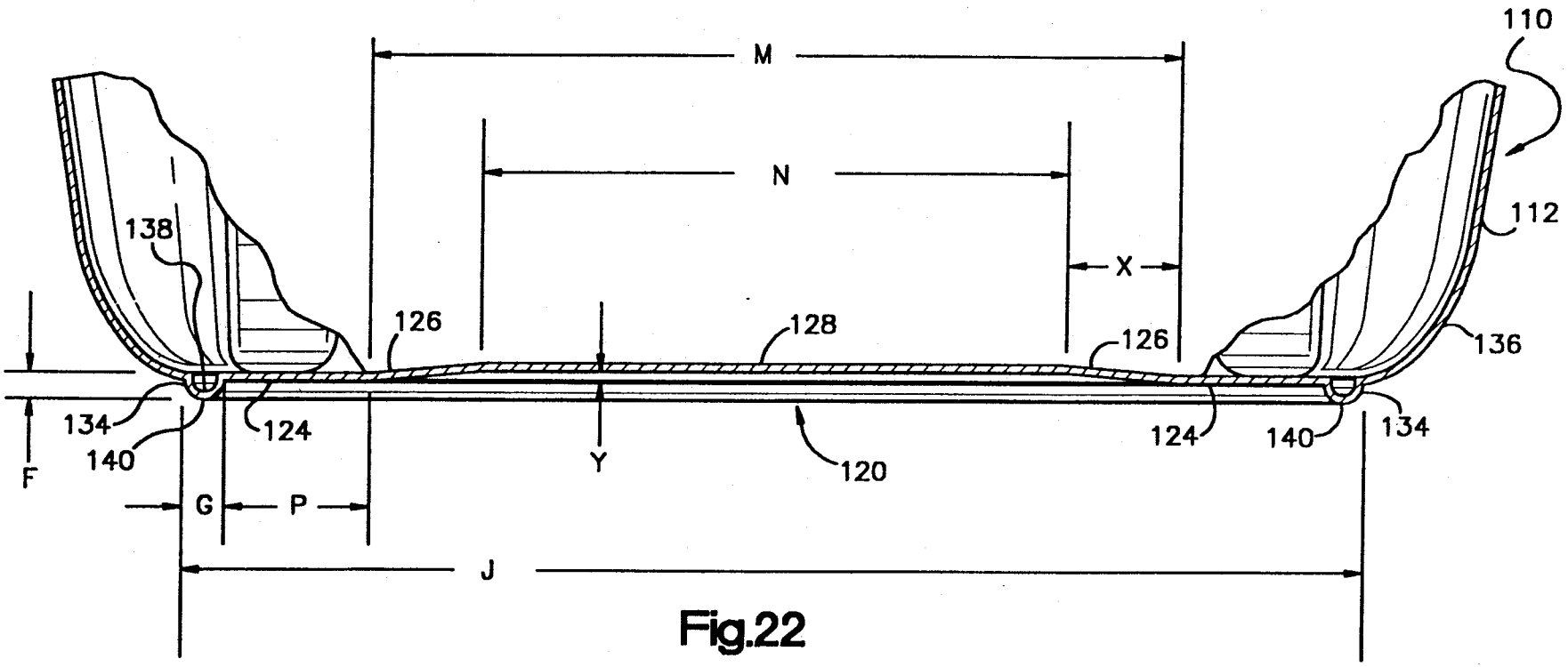

FIG. (*9a–b*) is a somewhat schematic cross sectional view depicting an upstanding "nest" of four of the configured containers, and showing this nest compares favorably in required storage space with a stack of two conventional containers of corresponding capacity;

FIG. 10 is a somewhat schematic side elevational view of an apparatus utilized to effect configuration of containers of the type shown in FIG. 1 to form containers of the type shown in FIG. 3;

FIG. 11 is a top plan view of the apparatus as seen from a plane indicated by a line 11—11 of FIG. 10;

FIG. 12 is a side elevational view of the apparatus of FIG. 10 with portions broken away and shown in cross section, and with a container of the type that is depicted in FIG. 1 shown as it is introduced into the die of the apparatus;

FIGS. 13 through 17 is a series of side elevational views that are similar to FIG. 12 with selected portions of the apparatus broken away, depicting stages in the process by which a container of the type that is shown in FIG. 1 is configured to form a container of the type shown in FIG. 3;

FIG. 18 is a sectional view that shows one mechanism for removing a container from the die of the apparatus;

FIG. 19 shows a container being removed from a multi-jaw expander apparatus utilized in a second state of container configuration to form a pair of circumferentially extending rings in side wall portions;

FIG. 20 is a perspective view of a container that embodies the preferred embodiment of the present invention;

FIG. 21 is a sectional view as seen from a plane indicated by a line 21—21 of FIG. 20; and, FIG. 22 is an enlargement of portions of the sectional view of FIG. 21.

DESCRIPTION OF THE PREFERRED EMBODIMENT

Figure 2:
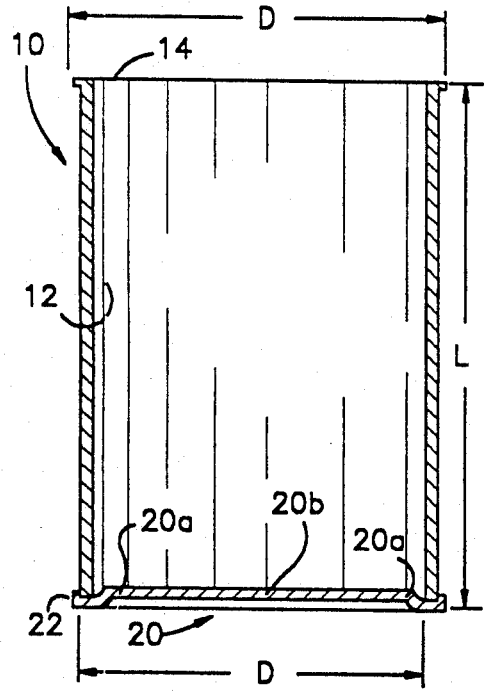
Fig.2 (PRIOR ART)
FIG. 2 is a sectional view thereof as seen from a plane indicated by a line 2—2 of FIG. 1.

Referring to FIGS. 1 and 2, a workpiece in the form of a conventional, open-top, generally cylindrical container such as a metal drum is indicated generally by the numeral 10. The workpiece 10 has an upstanding, generally cylindrical side wall 12 that is of substantially uniform diameter. The upper end of the side wall 12 has a rolled rim 14 that defines an upwardly-facing opening 16 for admitting contents into the workpiece 10. A circular, substantially planar bottom wall 20 closes the bottom end of the side wall 12, and is connected to the side wall 12 by a perimetrically extending seam 22, typically a rolled seam.

While the bottom wall 20 is formed from a single piece of metal sheet or plate stock that is of generally circular shape, selected portions of the bottom wall 20 are designated by different numerals. The numeral **20*b* designates a "central portion" of the bottom wall 20 (i.e., a central-most region of the bottom wall 20 that can be thought of as defining about ⅔ of the diameter of the workpiece 10). The numeral 20*a* designates "peripheral portions" of the bottom wall 20 (i.e., an annular band of material that defines the remainder of the bottom wall 20 and that extends circumferentially about the central portion 20*b***).

Referring to FIG. 2, the workpiece 10 has an overall length or height that is designated by the dimension L. The workpiece 10 is of substantially uniform diameter along its length, and its diameter is designated by the dimension D. While features of the present invention are not limited in utility to applications that involve reusable industrial drums, for purposes of this discussion the workpiece 10 will be assumed to comprise a standard, reusable industrial drum having a length L of about 34 inches, and a diameter D of about 24 inches.

Referring to FIGS. 3–8, 20 and 21, a container (of the type shown in FIGS. 1 and 2) that has been configured in accordance with the preferred practice of the present invention is indicated generally by the numeral 110. The container 110 has an upstanding side wall 112 (portions of which are defined by the side wall 12 of the original workpiece 10, and portions of which are defined by the peripheral portions **20*a* of the bottom wall 20. The upper end of the side wall 112 has a rolled rim 114 that is identical to the rim 14 that defines an upwardlyfacing opening 116 that is identical to the opening 16 for admitting contents into the container 110**.

Spaced downwardly from the rim 114 a short distance are a pair of circumferentially extending ring-like formations 130, 132 that are formed by expanding upper portions of the side wall 112 through the use of expander apparatus 300 depicted in FIG. 19. The rings 130, 132 are vertically spaced one from another by a short distance, are substantially identical when viewed in cross section (see FIG. 21), and have substantially uniform radially-extended cross sectional configurations in all axial planes of cross section.

A circular bottom wall 120 is defined by central portions **20*b* of the original bottom wall 20. Extending circumferentially about the circular bottom wall 120 is a depending ring-like formation 134 that provides a transition between and securely connects (in a contiguous and uninterrupted manner) the circular bottom wall 120 with upwardly curved peripheral bottom wall portions 136 that are defined principally by the peripheral portions 20*a*. The ring 134 provides a bottom surface 140 that extends in a horizontal plane for supporting the container 110 atop a flat support surface, not shown. The ring-like formation 134 defines an upwardly opening, ring-like trough 138 (see FIG. 22) that opens into the container 110 for receiving a quantity of such liquid or other material introduced into the container 110**.

The container 110 has a seam 122 that is of relatively complex configuration with portions tracing an outline that snakes radially inwardly and outwardly along the side wall surface among tapered flute formations 142. The seam 122 also snakes axially in a waveform of relatively small amplitude which may vary from container to container, depending on the character of the forces that are generated during elongation of the workpiece 10 and on the strain response that side wall portions of the workpiece 10 exhibit during the configuration process.

Figure 4:
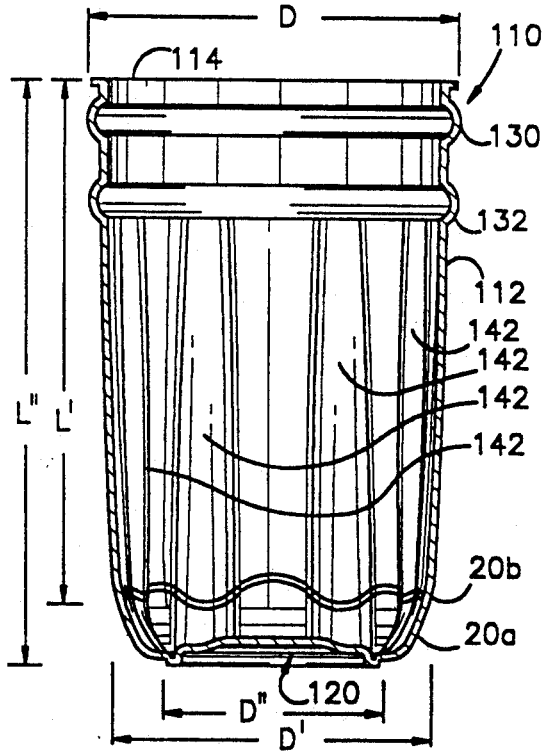
FIG. 4 is sectional view of the container of FIG. 3 as seen from a plane indicated by a line 4—4 of FIG. 3.
Figure 5:
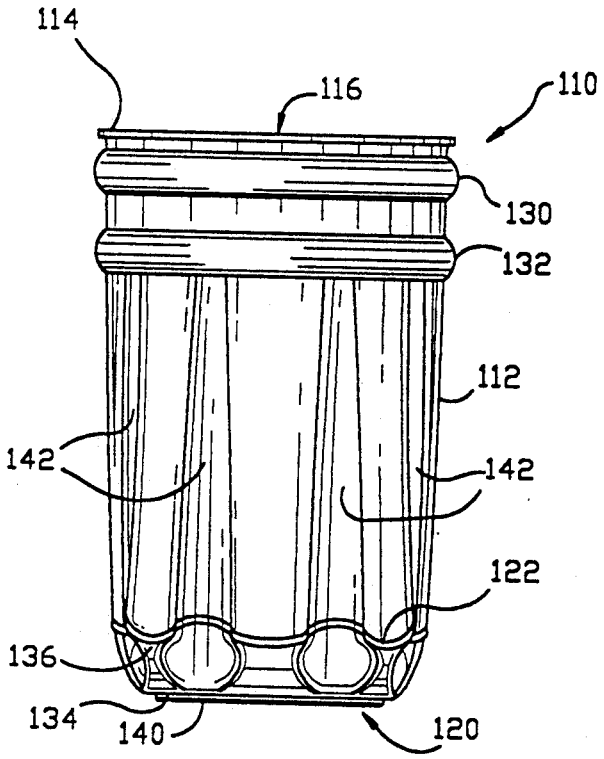
FIG. 5 is a side elevational view of the configured container of FIG. 3.
Figure 6:
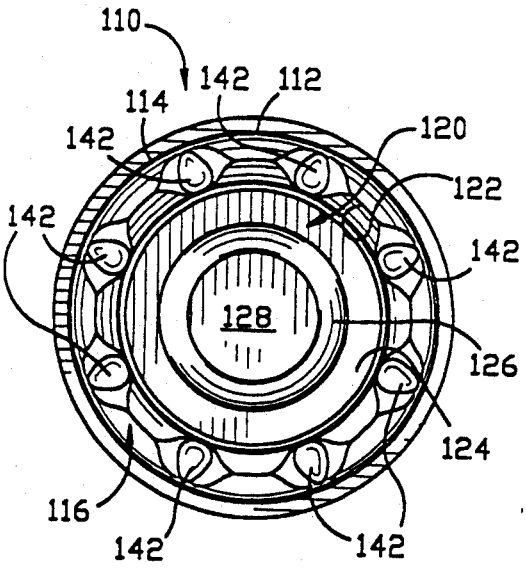
FIG. 6 is a top plan view of the FIG. 3 container.
Figure 7:
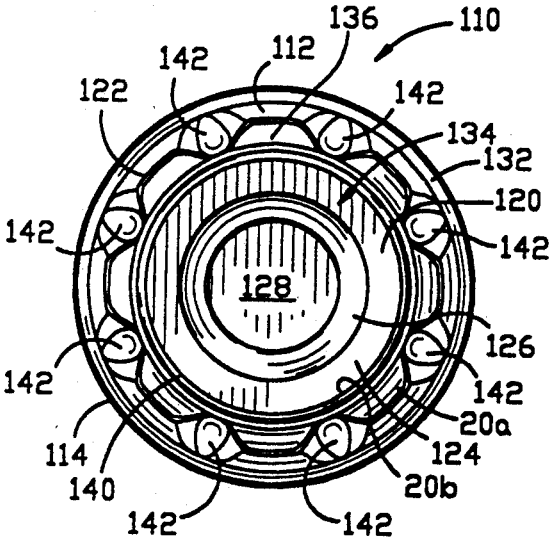
FIG. 7 is a bottom plan view of the FIG. 3 container.
Figure 8:
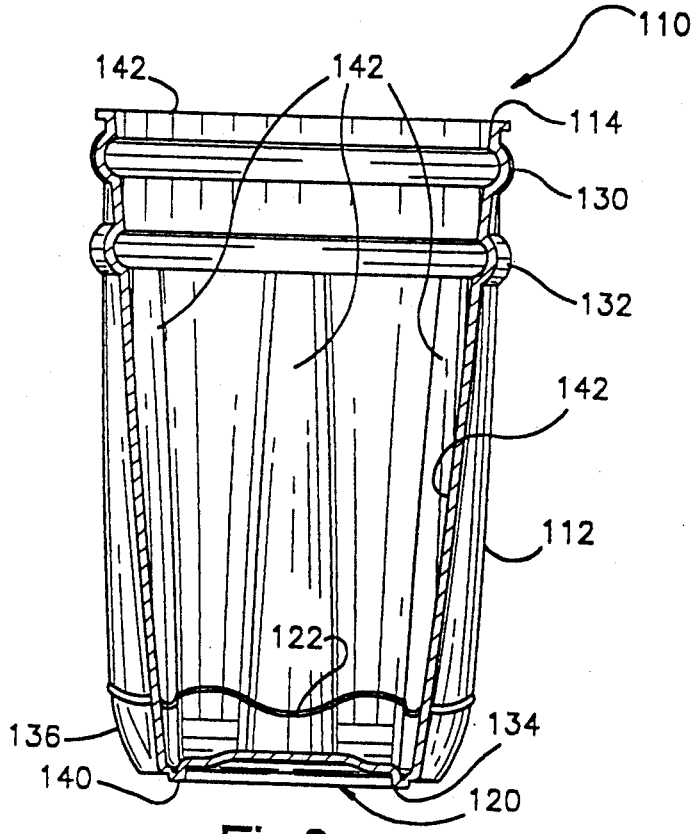
FIG. 8 is a sectional view as seen from a plane indicated by a line 8—8 of FIG. 3.

Referring to FIG. 4, the distance between the rim 114 and the seam 122 is designated in a general way by a dimension L' (which remains substantially unchanged from the original dimension L). It will be understood, however, that in view of the complex configuration of the seam 122, the dimension that is designated by the letter L' is approximate and designates the general location of the seam 122 relative to the rim 114.

Referring still to FIG. 4, the container 110 has an overall length or height that is designated by the dimension L''. The container 110 is of non-uniform diameter along much of its length, with the diameter of the container 110 at locations within the vicinity of the rim 114 being designated by the dimension D (a dimension that remains substantially unchanged from what is depicted in FIG. 2). The walls taper inwardly from the lower rim formation 132. Due to the presence of the flutes, the lengths of a diameter in the vicinity of the seam or connection 122 depends on the plane of cross section. The maximum diameter of the container 110 in the vicinity of the seam 122 is designated by the dimension D', and the diameter of the circular bottom wall 120 is designated by the dimension D''. When the container 110 is formed from an industrial drum having length and diameter dimensions L and D of about 34 inches and 24 inches, respectively, the resulting container 110 preferably has L'', D' and D'' dimensions of about 37½ inches, 21 inches and about 16 to 17 inches, respectively, Referring to FIG. 22, where bottom portions of the container 110 are shown in cross section on an enlarged scale, the ring-like formation 134 has an outer diameter that is indicated by the dimension J, with the height of the ring 134 being indicated by the dimension F, and with the width of the ring 134 (as measured radially) being indicated by the dimension G.

The bottom wall 120 is raised above the ring-like bottom surface 140 by an amount that is substantially equal to the dimension F. While the bottom wall 120 extends substantially horizontally, in preferred practice, the bottom wall 120 is not entirely flat. Rather, the bottom wall 120 has an annular outer part 124 that extends radially inwardly for a distance that is indicated by the dimension P, with the material that forms the outer part 124 extending in a horizontal plane that is raised above the bottom surface 140 by an amount equal to the dimension F. Joining integrally, smoothly and contiguously with the inner diameter of the outer part 124 is an inclined annular part 126 that extends radially inwardly for a distance that is indicated by the dimension X. Joining integrally, smoothly and contiguously with the inner diameter of the annular part 126 is a circular central part 128 that extends in a horizontal plane located above the plane of the outer part 124 by a distance that is indicated by the dimension Y.

By way of example, an industrial 55 gallon drum made in accordance with the present invention, has a rim dimension D and an overall height dimension L'' (see FIG. 4 where these dimensions are depicted) of about 24 inches and 37 ½ inches, respectively. Such a drum most preferably has dimensions J, F and G of about 16 inches, ⅜ inch and ½ inch, respectively (with the dimension F preferably being within the range of about ¼ inch to about ½ inch, and with the dimension G preferably being within the range of about ⅜ inch to about ⅝ inch). Such a drum preferably has dimensions M and N of about 11 inches and 8 inches, respectively, with dimension X and P being about 1½ and 2 inches, respectively. The dimension Y (the height of the center part 128 above the outer part 124) is typically selected to be about ⅛ inch.

Referring to FIGS. 3 through 8, the fluted shape (and other features) of the container 110 are illustrated. Flute formations 142 comprise a plurality of substantially identical, smoothly tapering formations that are characterized by surfaces that arc smoothly and relatively gently about the side wall 112 of the container 110. In the preferred embodiment, the flute formations 142 are eight in number—with the flute formations 142 being arranged symmetrically in opposed pairs with respect to an imaginary center axis of the container 110. Other numbers of flute formations 142 can be utilized, as can flute formations (not shown) that are of larger and/or smaller dimensions than the formations 142, and/or that are not identical one to another—to accommodate various container types and shapes, and to provide different degrees of taper along selected side wall portions.

The configuration of the workpiece 10 to form the container 110 is carried out in a two-stage process, beginning with the utilization of a press 200 (see FIGS. 10–18) that operates on workpieces one at a time, to effect major configuration changes that give the resulting containers a capability to be nested, and completing the process by utilizing an expander apparatus 300 (see FIG. 19) to expand selected upper portions of the workpieces to provide the pair of circumferentially extending rings 130, 132.

The press 200 is used to force a closed bottom end region of each generally cylindrical workpiece 10 into a die, and to carry out a drawing operation. This operation alters bottom and side wall portions of the workpiece 10 to elongate it and to provide formations 142.

The expander 300 is used to expand rim-end portions of the containers to provide the ring-like formations 130, 132 that enhance container strength and improve container handling characteristics.

Figure 9A:
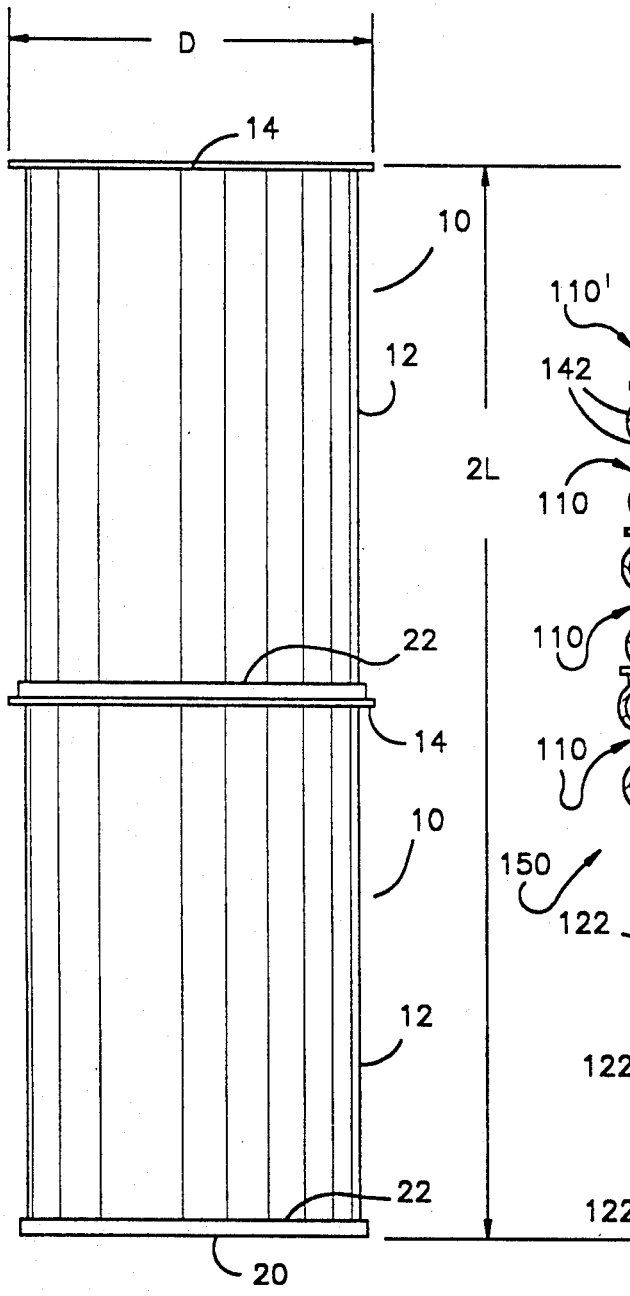
Figure 9B:
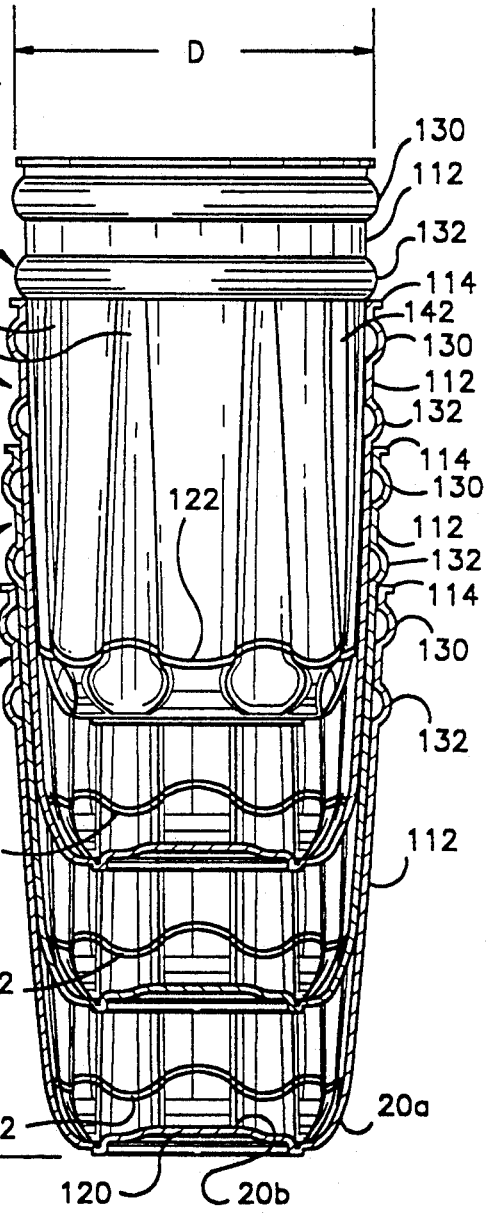

Reference is made to FIG. 9 wherein four of the containers 110 are shown in nested relationship (i.e., with portions of three of the four containers 110 extending into supporting and underlying ones of the containers 110) to form a "nest" designated generally by the numeral 150. A feature of the nest 150 is that rim formations 114 of the lowermost three containers 110 respectively engage the ring-like formations 132 of the three uppermost containers 110 to assure that the nested containers 110 do not wedge together to assure easy separation. Nesting the containers 110 as illustrated in FIG. 9, significantly diminishes the amount of space that is required to house the containers 110. In fact, the effective capacity of a given storage or transportation space can be doubled, or more than doubled.

To better understand how the containers 110 of the present invention can double or more than double the effective capacity of a given space, one need only to compare the way in which empty containers presently are stored with a nest of containers 110. In FIG. 9 a nest 150 of four drums 110 is shown to occupy a floor footprint and a height less than two conventional drums stacked one atop the other. Likewise, a seven-drum nest (not shown) will occupy about the same floor footprint and height consumed by three conventional drums stacked one atop another.

An additional factor that enhances the ease and efficiency with which the drums can be handled is a nest of several drums that form a relatively solid structure that can be handled by equipment such as fork lift trucks far more easily than can conventional drums that must be dealt with individually.

Furthermore, inasmuch as the drums within a nest have wall portions that extend one inside the other, the drums that comprise a nest tend to reinforce each other during handling and storage, and therefore are significantly less likely to be damaged while empty.

Still another factor that enhances efficiency through the use of the drums of the present invention is that relatively large nests of drums (e.g., a nest of typically eighteen to twenty four drums) can be handled as one would handle a lengthy cylindrical object. Further, inasmuch as the number of drums that are nested can be selected to correspond with the height (or length) of a space that is to contain empty drums, drums can be loaded into the available space, far more efficiently than is possible with conventional drums.

An aspect of the invention that derives from the discovery that bottomseamed containers can be reconfigured with relative ease, is the provision by the present invention of a means for economically fabricating new, nestable containers that incorporate the advantageous features of the containers 110. Stated in another way, one of the features of the present invention is that it enables new, relatively complexly configured, nestable containers to be manufactured quite easily and inexpensively 1) by forming workpieces 10 resembling conventional cylindrical containers from a coil of steel to form a side wall that is joined to a circular bottom plate, and 2) by subjecting these newly formed cylindrical workpieces to the draw-forming process.

A further feature of the present invention is that, as containers such as standard 55 gallon drums are reconfigured, the decrease in fluid-carrying capacity that results as side wall portions are fluted and folded inwardly is compensated for by the elongation that takes place as peripheral bottom wall portions are folded upwardly to serve as extensions of the side walls.

Referring to FIGS. 10–18, container configuration is carried out as by utilizing the press 200. The press 200 includes an upstanding frame 210 that supports a hydraulic cylinder 220 having a downwardly extensible ram 230. The cylinder 220 is located above a hollow die 240 that defines an upwardly opening cavity 250. The ram 230 is extensible downwardly into the cavity 250.

The hydraulic cylinder 220 is supported by the frame 210 to centrally overlie the die cavity 250. Movement of the ram 230 is along an imaginary axis 260 that extends vertically and centrally into the die cavity 250. The ram 230 has a circular end member 232 with a diameter that is about two thirds of the diameter of a cylindrical drum 10 that is to be inserted into the die cavity 250 for configuration by the apparatus 200. If the workpiece 10 is a 24 inch diameter drum (as has been described), the diameter of the end member 232 preferably is within the range of about 17 to 18 inches. The ram 230 acts on the central portion **20*b* of the end wall 20 of the workpiece 10 to permit peripheral portions 20*a* of the end wall 20 to be folded axially to define an extension of the side wall 12 as the workpiece 10 is configured to form the container 110**.

The die 240 has a circular side wall 242 that flairs upwardly, concentrically about the axis 260 from a bottom wall 244. Inwardly extending ribs 246 are provided on the interior of the side wall 242, with the ribs 246 being of tapered, smoothly rounded configuration to enable the material of the workpiece 10 to slide along the ribs 246 as the workpiece 10 is being configured to the finished shape of the container 110. Preferably, tapered formations 248 also are provided adjacent the bottom wall 244 to assist the ribs 246 in properly inwardly folding, bending and configuring the peripheral portions **20*a* to form a smooth transition between the bottom 120 and the side wall 112**.

The die 240 has bottom wall portions 245 that extend about and cooperate with features of an upwardly facing ejection ram 290 to form and define a plurality of features of the bottom region of the container (including a majority of the features that are depicted in FIG. 22). The bottom wall portions 245 define an opening that receives an enlarged head portion of the ejection ram 290. An annular groove 282 is defined about the circumference of the enlarged head of the ejection ram 290 to enable a depending ring formation 279 that is carried by the downwardly facing end portion 232 of the ram 230 to press-form the ring-like formation 134. Likewise, the upwardly facing head portion of the ejection ram 290 and downwardly facing surface portions of the ram 230 are cooperatively configured to provide a "crown" formation located centrally in the bottom wall 120. Thus, these cooperative ram surfaces are configured to form the annular and central parts 126, 128.

Referring to FIG. 12, a follower assembly 270 is movably supported on the ram 130. The assembly 270 includes a transversely extending base member 272 that has a central hole 274 which receives the ram 230 in a slip fit that enables the base member 272 to move axially along the ram 230. An outer ring structure 276 depends from the base member 272 and is configured to be received within uniform diameter upper portion 252 of the die cavity 250 in a slip fit. An inner ring structure 278 depends from the interior of the outer ring member 276 and is sized to extend into the opening 16 of a workpiece 10 in a slip fit to reinforce the rim 14 of a workpiece 10 during the configuration of the workpiece 10.

The remainder of the die cavity 250 below the upper portion 252 is of a relatively small diameter that is selected to permit the seam 22 of the workpiece 10 to pass therethrough in a slip fit.

Figure 13:
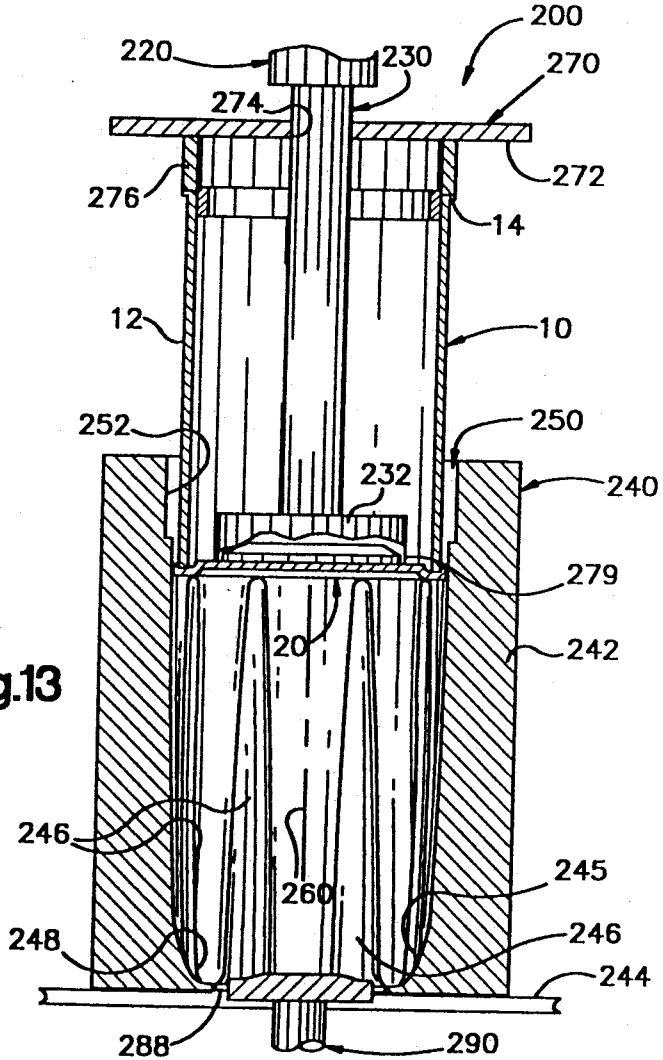

In FIG. 12, the workpiece 10 is shown loaded into the upper portion 252 and has slipped downwardly further into the die cavity 250 under the influence of gravity to a position wherein the seam 22 engages the upper end regions of the ribs 246. In FIG. 13, the ram 230 is shown extended into the container 10 with the enlarged end region 232 in engagement with the central portion **20*b*. As illustrated in FIG. 13, the follower 270 has dropped with the ram 230 to a position where the inner ring member 278 has extended inside the container opening 16 with the outer ring member 276 resting in engagement with the top of the rim 14. The follower 270 remains in engagement with the upper end region of the container 10 in the manner that is depicted in FIG. 13** throughout the process of configuring the container.

Figure 14:
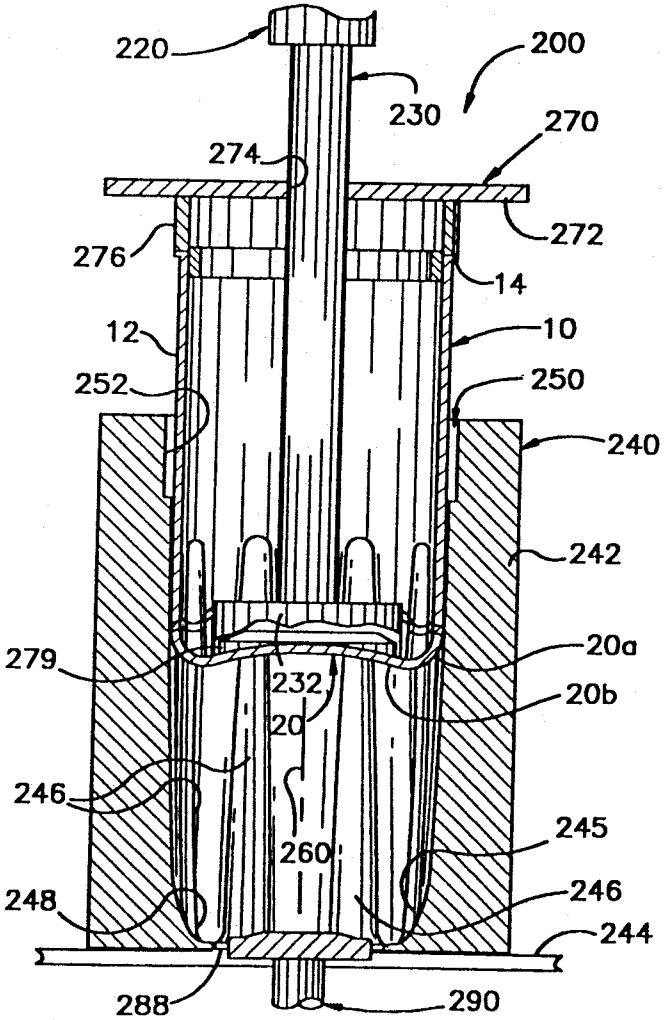
Figure 16:
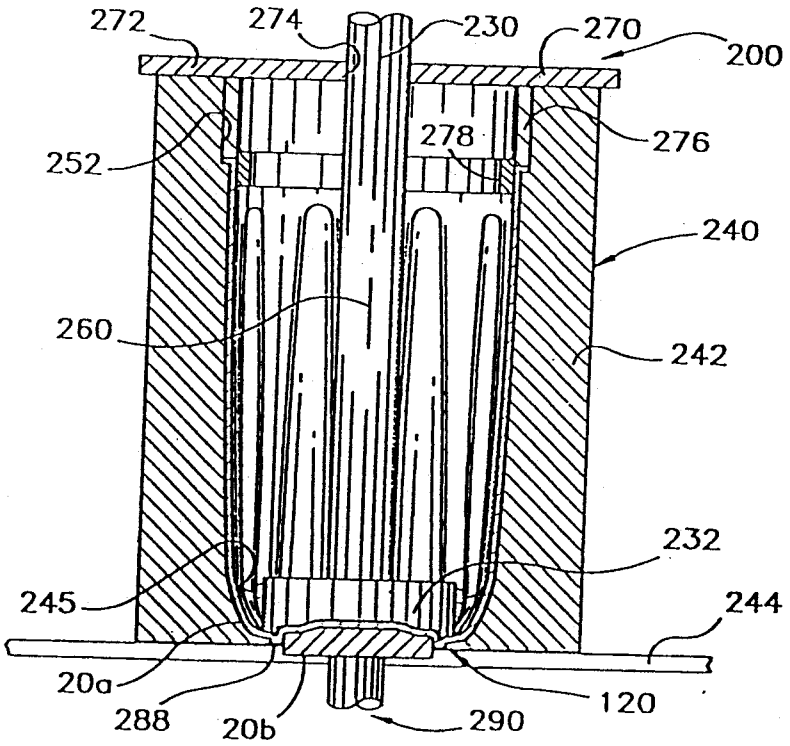
Figure 15:
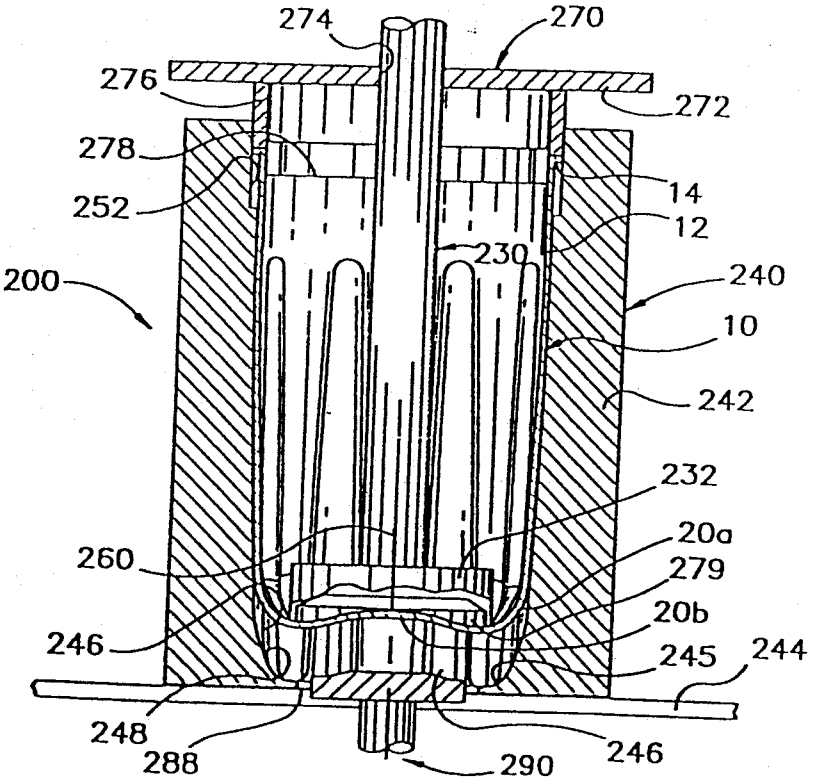

Referring to FIGS. 14 through 16, as the ram 230 is progressively extended to drive the bottom wall 20 of the workpiece 10 into the die cavity 250 (and eventually into engagement with the bottom wall 244), the flutes 246 are formed gradually and progressively, the bottom wall 20 of the workpiece is configured to elongate the container 10 and to define the ring-like formation 134 as well as the raised parts 126 and 128. The rim 14 is held in its desired shape and configuration by upper portions of the die 240 which cooperate with the follower 270 to confine the upper end region of the workpiece.

Figure 17:
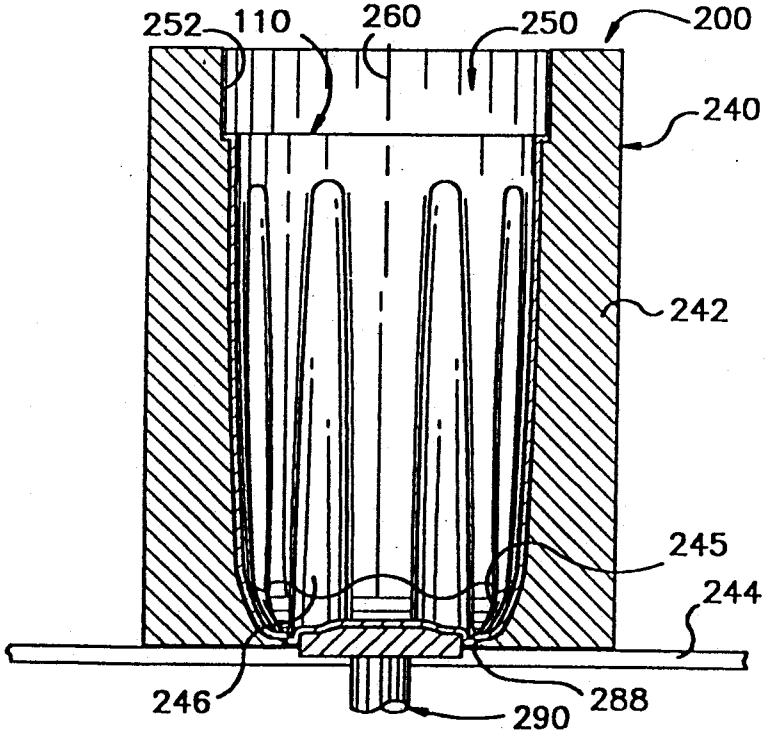

Referring to FIG. 17, when the ram 230 is withdrawn, the follower 270 moves upwardly with it, leaving the newly formed container 110 residing within the mold cavity 250. The container 110 is removed from the die 240, as is illustrated in FIG. 18, by moving the extractor ram 290 upwardly.

Referring to FIG. 19, once a container has been configured by the press 200, a further configuration procedure preferably is carried out as by positioning the rim end regions, one at a time, in surrounding relationship to a conventional multi-jaw expander apparatus 300. The apparatus 300 preferably has as many as twelve or more radially movable jaws 310 that are retractable to a closely grouped array, as is depicted in FIG. 19. After the rim end region of a container is slipped over the array, the jaws 310 are moved radially outwardly, with radially outwardly projecting bars 312 of the jaws expanding container side wall portions to form the ring-like formations 130, 132.

Although the invention has been described in its preferred form with a certain degree of particularity, it will be understood that the present disclosure of the preferred form has been made only by way of example, and that numerous changes in the details of construction and the combination and arrangements of parts may be restored to without departing from the spirit and scope of the invention as hereinafter claimed.

What is claimed is:

1. A nestable container that is formed as a product of a process utilizing an open-top metal work piece having sheet stock arranged in an uninterrupted ring-like band defining a side wall that extends with substantially uniform diameter between spaced ends, the side wall including a rim formation adjacent one of the ends for surrounding an opening that is of substantially the same diameter as the side wall, the work piece also having a metal sheet stock bottom wall connected circumferentially to and closing the other end and cooperating with the side wall to form an open-top work piece, the process comprising configuring the work piece into a container that has:

(a) first side wall portions that are substantially unchanged in configuration near the rim formation to maintain the opening unchanged in size and shape, (b) second side wall portions that are tapered along at least a majority of the length of the side walls to diminish the diameter of the container as the side wall approaches the bottom wall, (c) third side wall portions that extend between and provide a contiguous and uninterrupted connection between the first and second side wall portions, (d) a plurality of tapered flute formations extending along the second side wall portions and being defined by a plurality of smoothly curved surfaces that are introduced into the second side wall portions to give the second side wall portions a tapered, fluted configuration that narrows in diameter as it approaches the bottom wall, the flute formations extending across the connection of the second side wall portions to peripheral portions of the bottom wall, (e) the bottom wall having a substantially circular central portion thereof that is moved axially from the vicinity of the connection in a direction extending away from the rim formation to effectively elongate the container and to define a circular container bottom having an outer diameter that is smaller than is the diameter of the first side wall portions, peripheral portions of the bottom wall extending from the vicinity of the connection toward the central portion of the bottom wall being complexly configured transition surfaces that extend the flute formations downwardly from the vicinity of the connection and curve radially inwardly toward the central portion, (f) the bottom wall including a depending ring-like formation circumferentially surrounding the central portion providing a contiguous and uninterrupted connection between the peripheral portions of the bottom wall and the central portion; and (g) the side and bottom walls including their connection being imperforate such that the container has a fluid-carrying capability.

2. The nestable container of claim 1 wherein the depending ring-like formation provides bottom surface means including a ring-like bottom surface that extends within a substantially horizontal plane for engaging a flat, horizontal support surface along at least a sufficient portion of the circumferential length of the ring-like bottom surface to support the nestable container in a stable manner atop such a support surface.

3. The nestable container of claim 1 wherein the depending ring-like formation is of channel-shape defining a ring-like trough that opens upwardly into the interior of the nestable container for receiving a portion of a substance introduced into the container.

4. The nestable container of claim 1 wherein the substantially circular central portion of the bottom wall has at least a centrally located part that is crowned upwardly to extend slightly into the interior of the container from a surrounding peripheral part of the bottom wall.

5. The nestable container of claim 4 wherein said peripheral part is substantially annular and extends in a substantially horizontal plane when the container is supported on a horizontal surface.

6. The nestable container of claim 1 wherein the flute formations extend along the majority of the length of the side wall of the reconfigured container.

7. The nestable container of claim 6 wherein the flute formations are of substantially identical configuration as compared one with another.

8. The nestable container of claim 1 wherein the flute formations are provided at substantially equally spaced locations about the circumference of the side wall of the container.

9. The nestable container of claim 8 wherein there are an even number of the flute formations, and the flute formations are arranged about the circumference of the side wall in opposed pairs.

10. The nestable container of claim 1 wherein the outer diameter of the bottom is about two-thirds of the diameter of the first side wall portions.

11. The nestable container of claim 1 wherein the containers are shaped to permit like containers to be nested in an upwardly extending nest, with the height of a nest of four containers not exceeding the equivalent height of two of said generally cylindrical work pieces stacked one atop another.

12. The nestable container of claim 1 additionally including a circumferential ring-like formation in the third side wall portions for providing at least one radially outwardly extending ring-like bulge in said side wall.

13. The nestable container of claim 12 wherein there are a pair of said ring-like bulges at horizontally spaced locations in the third side wall portions.

14. A nestable, open-top container comprising:

(a) a ring-like band of metal that extends about a central axis between an upper end region and a lower end region including:

(i) an upper section including a rim formation that surrounds an opening for introducing contents into and for removing contents from the container, the upper end section also including a substantially constant diameter first side wall portion that depends coaxially along the central axis from the rim formation;

(ii) a second side wall portion, the second wall portion being a fluted, tapered wall portion joined contiguously with the upper section and depending along the central axis from the section;

(iii) the fluted, tapered wall portion being spaced downwardly from the rim formation and extending to the lower end region;

(b) a bottom wall connected to the fluted, tapered wall portion and including an uninterrupted piece of metal having a central portion providing a container bottom transverse to and intersected by the central axis with the central portion being spaced beneath the fluted, tapered wall portion when the container is upright;

(c) the bottom having a peripheral portion joined contiguously with the central portion and providing a smooth transition between the container bottom and the fluted, tapered wall portion;

(d) the bottom wall means and the sidewall means having been formed during a die produced configuration of the side wall portion;

(e) the fluted, tapered wall portion having flutes and tapers extending continuously from said upper section to said bottom connection, the flutes being joined with like produced flute extensions in the peripheral portion providing an upstanding side wall that is tapered and fluted along at least a majority of its length with a diminishing diameter from the upper section to the bottom; and (f) at least a selected one of the side wall and the bottom being provided with ring-like formation located near a selected one of said upper and lower end regions of said sidewall, with the ring-like formation defining an inwardly facing trough that opens into the interior of the container, and with the ring-like formation being engageable to at least assist in supporting the container.

15. The nestable container of claim 14 wherein the ring-like formation includes at least one radially outwardly extending bulge-like formation that extends circumferentially about the side wall at a location near the upper end of the fluted, tapered side wall portion.

16. The nestable container of claim 15 wherein, when said container is nested within a like container, the ring-like formation of the one container is engageable with the rim formation of said like container.

17. The nestable container of claim 14 wherein the ring-like formation includes a pair of vertically spaced bulge-like formations that extend circumferentially about the side wall at a location above but near the upper end of the fluted, tapered side wall portion.

18. The nestable container of claim 12 wherein the depending bulge-like formation is of channel-shape that defines a ring-like trough that opens into and the communicates with the interior of the container.

19. The container of claim 17 wherein the central portion has at least a centrally located part that is crowned upwardly to extend slightly into the interior of the container.

20. The nestable container of claim 14 wherein the ring-like formation includes a depending, bulge-like formation that is located near the lower end region.

21. The nestable container of claim 20 wherein the bulge-like formation forms a transition and provides a connection between the peripheral portion and the central portion, with the bulge-like formation circumferentially surrounding the central portion and extending downwardly therefrom to define a ring-like bottom surface for engaging a horizontal support surface for supporting the nestable container.

22. An apparatus for reconfiguring a generally cylindrical work piece having a generally cylindrical side wall of substantially uniform diameter extending between an open end defined by one end region of the side wall, and a closed end that is defined by a generally circular bottom wall that is connected to an opposed end region of the side wall circumferentially about the wall, to provide a container that is tapered to narrow in diameter along the length of its side wall with a plurality of circumferentially spaced, inwardly tapering ribs extending along a least a majority of the length of the side wall and extending across the connection of the side wall to the bottom wall and extending into portions of the bottom wall, such container being nestable within portions of a like container, comprising:

(a) die means having an open ended cavity of generally circular cross section for receiving the closed end region of the work piece, the cavity having a plurality of projections that taper inwardly for forming tapering ribs in the side wall and bottom wall of the container, and having bottom means configured for providing containers each with a depending ring-like support formation that surrounds a central region of the bottom wall;

(b) ram means for inserting into the work piece to engage portions of the inside surface of the bottom wall to force the container into the die cavity for reconfiguring the work piece by positioning the work piece for movement into the die cavity, and by forcing the ram into contact with interior surface portions of the bottom wall to force the work piece into the die cavity to form a container that is tapered narrowing in diameter along the length of its side wall, the container having a plurality of circumferentially spaced, inwardly tapering ribs extending along at least a majority of the length of the side wall and extending across the connection of the side wall to the bottom wall and extending to portions of the bottom wall to provide a container that is nestable within portions of a like container; and, (c) the ram means being configured to cooperate with the die means for providing containers each with a depending ring-like support formation that surrounds a central region of the bottom wall of the container.

23. The apparatus of claim 22 additionally including retainer means for engaging the side wall of the work piece in the vicinity of the open end region thereof to maintain dimensional and shape stability during reconfiguration.

24. The apparatus of claim 23 wherein the retainer means is relatively movably connected to the ram.

25. The apparatus of claim 22 wherein the tapering ribs are arranged in opposed pairs on opposite sides of the die, are substantially equally spaced about the interior of the die, and are of substantially identical configuration as compared one with another.

26. The apparatus of claim 22 additionally including means connected to the die for engaging a container formed within the die for removing the container.

27. A nestable, open-top container comprising:

(a) a ring-like band of metal that extends about a central axis between an upper end region and a lower end region including:

(i) an upper section including a rim formation that surrounds an opening for introducing contents into and for removing contents from the container, the upper end section also including a substantially constant diameter first side wall portion that depends coaxially along the central axis from the rim formation;

(ii) a second side wall portion, the second wall portion being a fluted, tapered wall portion joined contiguously with the upper section and depending along the central axis from the section;

(iii) the fluted, tapered wall portion being spaced downwardly from the rim formation and extending to the lower end region;

(b) a bottom wall connected to the fluted, tapered wall portion and including an uninterrupted piece of metal having a central portion providing a container bottom transverse to and intersected by the central axis with the central portion being spaced beneath the fluted, tapered wall portion when the container is upright;

(c) the bottom having a peripheral portion joined contiguously with the central portion and providing a smooth transition between the container bottom and the fluted, tapered wall portion;

(d) the fluted, tapered wall portion having flutes and tapers extending continuously from said upper section to said bottom connection, the flutes being joined with like produced flute extensions in the peripheral portion providing an upstanding side wall that is tapered and fluted along at least a majority of its length with a diminishing diameter from the upper section to the bottom; and (e) at least a selected one of the side wall and the bottom being provided with ring-like formation located near a selected one of said upper and lower end regions of said sidewall, with the ring-like formation defining an inwardly facing trough that opens into the interior of the container, and with the ring-like formation being engageable to at least assist in supporting the container.

28. The nestable container of claim 27 wherein the ring-like formation includes at least one radially outwardly extending bulge-like formation that extends circumferentially about the side wall at a location near the upper end of the fluted, tapered side wall portion.

29. The nestable container of claim 28 wherein, when said container is nested within a like container, the ring-like formation of the one container is engageable with the rim formation of said like container.

30. The nestable container of claim 27 wherein the ring-like formation includes a pair of vertically spaced bulge-like formations that extend circumferentially about the side wall at a location above but near the upper end of the fluted, tapered side wall portion.

31. The nestable container of claim 30 wherein the depending bulge-like formation is of channel-shape that defines a ring-like trough that opens into and the communicates with the interior of the container.

32. The container of claim 30 wherein the central portion has at least a centrally located part that is crowned upwardly to extend slightly into the interior of the container.

33. The nestable container of claim 27 wherein the ring-like formation includes a depending, bulge-like formation that is located near the lower end region.

34. The nestable container of claim 33 wherein the bulge-like formation forms a transition and provides a connection between the peripheral portion and the central portion, with the bulge-like formation circumferentially surrounding the central portion and extending downwardly therefrom to define a ring-like bottom surface for engaging a horizontal support surface for supporting the nestable container.

35. A method of forming a nestable container from a metal workpiece comprising:

(a) configuring the workpiece to form a generally cylindrical sidewall having a top rim formation along a top portion of said sidewall, said rim formation being of a first diameter and defining a container opening;

(b) configuring the workpiece to form a bottom wall having a generally truncated conical shape;

(c) further configuring said sidewall such that said sidewall tapers from said first diameter to a second diameter at a bottom seam which connects said sidewall to said bottom wall;

(d) forming a plurality of tapered flutes extending within said sidewall spaced from said rim formation and extending into said bottom wall; and, (e) forming at least one ring-like formation extending within and around said sidewall, said formation defining an inwardly facing trough that opens into an interior of the container.

* * * * *